US008267095B2

(12) United States Patent
Markel

(10) Patent No.: US 8,267,095 B2
(45) **Date of Patent: *Sep. 18, 2012**

(54) COLORED SMOKE MODULE FOR CIGARETTE

(76) Inventor: Gal Markel, Haifa (IL)

( * ) Notice: Subject to any disclaimer, the term of this patent is extended or adjusted under 35 U.S.C. 154(b) by 588 days.

This patent is subject to a terminal disclaimer.

(21) Appl. No.: 12/324,413

(22) Filed: Nov. 26, 2008

(65) Prior Publication Data

US 2009/0071488 A1 Mar. 19, 2009

Related U.S. Application Data

(63) Continuation of application No. 11/106,530, filed on Apr. 8, 2005, now Pat. No. 7,546,839.

(51) Int. Cl.
*A24F 47/00* (2006.01)

(52) U.S. Cl. ..... 131/347; 131/360; 131/352; 131/361; 131/363

(58) Field of Classification Search ..... None
See application file for complete search history.

(56) References Cited

U.S. PATENT DOCUMENTS 2,094,614 A * 10/1937 Miller ..... 131/335
3,125,596 A * 3/1964 Figge ..... 560/128
4,887,617 A * 12/1989 Ruppert et al. ..... 131/70

* cited by examiner

*Primary Examiner* — Richard Crispino
*Assistant Examiner* — Michael J Felton
(74) *Attorney, Agent, or Firm* — McAndrews, Held & Malloy, Ltd.

(57) ABSTRACT

A colored smoke module is disclosed that is mountable to at least a portion of a cigarette or other smoking device. The colored smoke module produces colored smoke when burned. Further, the colored smoke module is user mountable to a cigarette or other smoking device.

12 Claims, 3 Drawing Sheets

COLORED SMOKE MODULE FOR CIGARETTE

RELATED APPLICATIONS

This application is a Continuation Application of U.S. patent application Ser. No. 11/106,530, "COLORED SMOKE MODULE FOR CIGARETTE," filed on Apr. 8, 2005, which application is incorporated herein by reference in its entirety.

FEDERALLY SPONSORED RESEARCH OR DEVELOPMENT

Not Applicable

MICROFICHE/COPYRIGHT REFERENCE

Not Applicable

BACKGROUND OF THE INVENTION

Many people around the world smoke cigarettes, cigars, nargillas (hookahs), pipes, and other smoking devices. As discussed in co-pending application "Cigarette with Colored Smoke," smoking devices that produce colored smoke could, for example, allow people to communicate something about either the smoking device being smoked or the person smoking the smoking device.

Cigarettes that are purchased with a pre-determined color of smoke that cannot be changed by individual smokers do not allow a user to vary the color of smoke produced. Also, due to limits on available shelf space in stores, such cigarettes may provide only a limited number of color options. Further, different smokers who want different colors of smoke could not share cigarettes from the same pack. Additionally, smokers may want to change color of smoke from cigarette to cigarette just for variety.

One object of the present invention is to utilize colored smoke modules that allow individual users to select and/or vary the color of smoke produced by cigarettes and/or other smoking devices.

BRIEF SUMMARY OF THE INVENTION

A colored smoke module for a cigarette or other smoking device, substantially as shown in and/or described in connection with at least one of the figures, as set forth more completely in the claims.

Various advantages, aspects and novel features of the present invention, as well as details of an illustrated embodiment thereof, will be more fully understood from the following description and drawings.

DETAILED DESCRIPTION OF THE INVENTION

Figure 1:
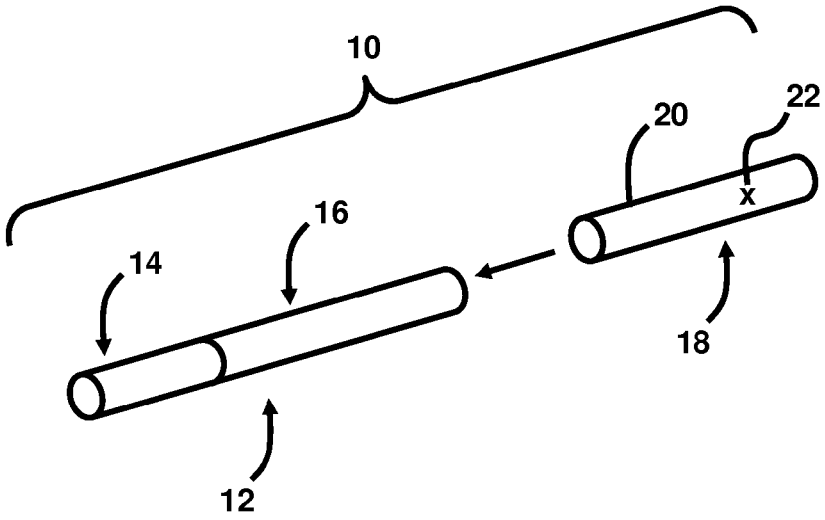
FIG. 1 illustrates a perspective view of a colored smoke module system formed in accordance with an embodiment of the present invention.

FIG. 1 illustrates a perspective view of a colored smoke module system 10. The colored smoke module system 10 includes a cigarette 12 and a colored smoke module 18. The cigarette 12 includes an inhalation portion 14 and a combustion portion 16. To smoke the cigarette 12, a smoker lights the end of the combustion portion 16 and draws smoke through the inhalation portion 14. The combustion portion 16 may include tobacco preformed as a rod with or without additives surrounded by a wrapping paper, while the inhalation portion 14 may include a filter to remove potentially harmful materials from the smoke being inhaled by the smoker.

The colored smoke module 18 includes a sleeve 20 and an indicator 22. The sleeve 20 is designed to fit on to the combustion portion 16 by being slid over the combustion portion 16. The opening of the sleeve 20 is sized to be large enough to allow it to be either slid on or off the combustion portion 16 while still being small enough to remain in place when on the combustion portion 16. The sleeve 20 may be constructed by dispersing a colored smoke producing material along a paper that is similar to the wrapping paper surrounding the combustion portion 16.

The indicator 22, shown as an "x" in FIG. 1, is a mark made on the sleeve 20. The indicator 22 provides a visual indication of the color of smoke produced by the sleeve 20. Alternatively, the indicator may be a color covering part or all of the sleeve 20. Also as an alternative, the colored smoke module 18 could use a removably mounted indicator, such as a tag that could be torn off before the sleeve 20 is mounted to the cigarette 12.

As an additional alternative, the indicator 22 may provide a visual indication of something other than the color of smoke produced by the sleeve 20 when burned. For example, the color of smoke produced may be communicatively significant, that is, it may be used to communicate something about the cigarette itself or the person smoking the cigarette. (For examples, see co-pending application "Cigarette with Colored Smoke," Ser. No. 11/107,772, which application is hereby incorporated in its entirety by reference). The indicator for such a module may provide a visual cue corresponding to the characteristic of a cigarette or smoker to which the color corresponds.

Figure 2:
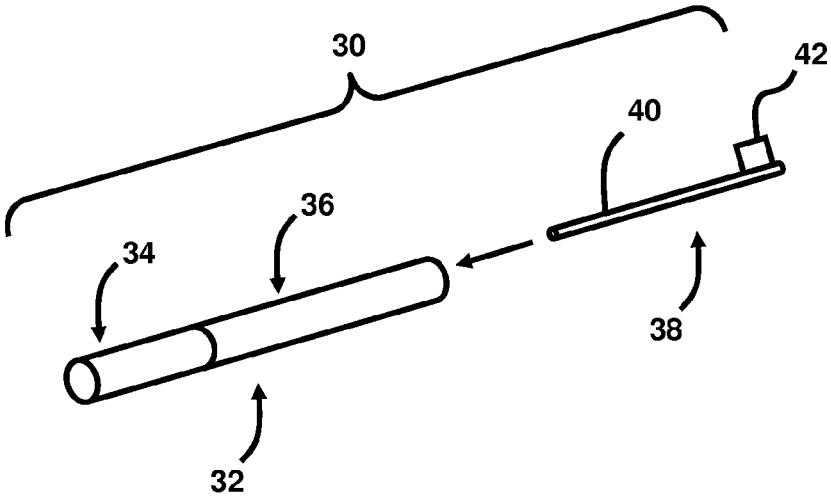
FIG. 2 illustrates a perspective view of a colored smoke module system formed in accordance with an embodiment of the present invention.

FIG. 2 illustrates a perspective view of a colored smoke module system 30. The colored smoke module system 30 includes a cigarette 32 and a colored smoke module 38. The cigarette 32 includes an inhalation portion 34 and a combustion portion 36. To smoke the cigarette 32, a smoker lights the end of the combustion portion 36 and draws smoke through the inhalation portion 34. The combustion portion 36 may include tobacco preformed as a rod with or without additives surrounded by a wrapping paper, while the inhalation portion 34 may include a filter to remove potentially harmful materials from the smoke being inhaled by the smoker.

The colored smoke module 38 includes a pin 40 and a tag 42. The pin 40 is designed to fit in the combustion portion 36 by being inserted through the open end of the combustion portion 36 before lighting the cigarette 32. The pin 38 should be narrow enough to be able to be inserted into the combustion portion 36, and rigid enough to avoid buckling during insertion into the cigarette 32. The tag 42 is mounted to the pin 40, and may be removed before the pin 40 is inserted into the combustion portion 36. The tag 42 provides a visual indication of the color of smoke produced by the pin 40 or a visual indication of a characteristic of the cigarette or smoker to which the color corresponds, as described above.

Figure 3:
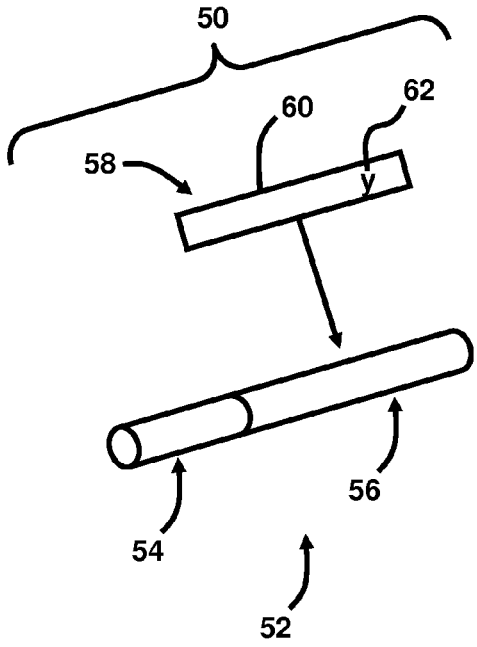
FIG. 3 illustrates a perspective view of a colored smoke module system formed in accordance with an embodiment of the present invention.

FIG. 3 illustrates a perspective view of a colored smoke module system 50. The colored smoke module system 50 includes a cigarette 52 and a colored smoke module 58. The cigarette 52 includes an inhalation portion 54 and a combustion portion 56. To smoke the cigarette, a smoker lights the end of the combustion portion 56 and draws smoke through the inhalation portion 54. The combustion portion 56 may include tobacco preformed as a rod with or without additives surrounded by a wrapping paper, while the inhalation portion 54 may include a filter to remove potentially harmful materials from the smoke being inhaled by the smoker.

The colored smoke module 58 includes a strip 60 and an indicator 62. The strip 60 is designed to be adhesively placed length-wise on the combustion portion 56. The indicator 62, shown as a "y" in FIG. 3, is a mark made on the strip 60. The indicator 62 provides a visual indication of the color of smoke produced by the strip 60. Examples of alternate types of indicators include those described above in connection with the embodiments of FIG. 1 and FIG. 2.

The embodiments illustrated in FIGS. 1-3 include a colored smoke module having a body, such as a sleeve, a pin, or an adhesive strip. The modules are user mountable—individual smokers may place and/or remove the modules from a cigarette. The body of the module is combustible, and contains a material that gives off colored smoke when the colored smoke module body is burned. For example, known materials that give off colored smoke may be found in products such as smoke bombs or fireworks. These materials, or other materials to be used, can be adapted (but not necessarily so) for use in cigarettes for such considerations as safety, burn rate, ease of production and/or compatibility with other cigarette materials, and any effect they may have on taste. As smoke from the module will be ingested by the smoker along with smoke from the cigarette itself, and also distributed to the atmosphere, the material used will ideally have no or low toxicity. The entire body of the module may be constructed from a colored smoke producing material, or the colored smoke producing material may be just a portion of the body added to other materials. As an additional example, the colored smoke module could be mounted to the cigarette in the form of a liquid or paste that is applied to the outside of the combustion portion.

After the cigarette to which it is mounted is lit, the colored smoke module gives off colored smoke as it burns. Because tobacco and the wrapper of the cigarette are also burning, the color of all the smoke leaving the cigarette may be different from that produced solely by the colored smoke module. Thus, to achieve a specified color of smoke, the colored smoke module provides a more intense shade of that particular color when burning alone. Because smoke inhaled by a smoker of a standard cigarette passes through a filter, the smoke later exhaled by the smoker may or may not be the same shade or color as the smoke exuding from the cigarette to which the colored smoke module is added.

As described more fully in incorporated co-pending application "Cigarette with Colored Smoke," the color of the smoke can be used for communication or identification purposes. For example, the color of the smoke can be used to identify a characteristic of the cigarette itself, or may also correspond to a quality of the person smoking the cigarette and/or to an event (such as a sporting event). Colored smoke modules may also provide colored smoke during only a portion of the burning of a cigarette, or may provide varying colors of smoke during the burning of the cigarette. This can be accomplished, for example, by using a colored smoke module body that is mounted to only a portion of the combustion portion of a cigarette, varying the amount and/or type of colored smoke producing material within the colored smoke module body, and/or using multiple smoke module bodies in combination.

A colored smoke module that is user mountable allows individual users to control and/or vary the color of smoke produced from cigarette to cigarette. This can provide a number of advantages. For example, a smoker could conserve colored smoke modules by mounting them to cigarettes only in certain situations. If the color of smoke were being used to communicate something about the smoker in a social situation, then the smoker could use them only in such situations, and not when smoking alone. The use of user mountable colored smoke modules also allows smokers to change the color of smoke in accordance with their mood, or to change the meaning of any information being communicated by the color of smoke, or just for variety. User mountable colored smoke modules also allow multiple smokers to share cigarettes from the same pack without having to use the same color of smoke. Further, user mountable colored smoke modules can provide a greater variety of color choices and options, as limited shelf space in stores for cigarettes may limit the variety of cigarettes that vendors are able to provide.

In an embodiment of the present invention, colored smoke modules are included in a kit with multiple modules. The modules from a kit may produce the same color of smoke, or, in alternative embodiments, different modules in a kit may produce different colors of smoke. The use of indicators, such as those described above in connection with the embodiments illustrated in FIGS. 1-3, can be especially beneficial to aid distinguishing modules from the same kit that produce different colors of smoke from each other. The use of different colors in the same kit allows a user to select the color of smoke regardless of type of cigarette, and/or to vary the color of smoke based on the social situation. Additionally, such a kit of colored smoke modules could include cigarettes for the modules to be mounted to as well.

Other embodiments of the present invention include colored smoke modules that may be used with smoking devices other than cigarettes, or which may be used with either cigarettes or other types of smoking devices. Examples of other types of smoking devices include cigars, cigarillos, nargillas (hookahs), and pipes. Examples of other types of module. In addition to those described above, include drops, tablets, and capsules.

One embodiment of the present invention utilizes a pipe having an inhalation portion including a mouthpiece and a combustion portion including a bowl into which tobacco is placed. A colored smoke producing capsule is also placed in the bowl. The inhalation portion and combustion portion are operatively joined by a tube interposed between the mouthpiece and bowl. Thus, the operatively joined inhalation portion and combustion portion may be directly connected, or may instead have additional components located between them.

Additional embodiments of the present invention include a colored smoke module that adds color to smoke that passes by the colored smoke module, instead of requiring the colored smoke module to be burned. In these embodiments, the smoke exuding from the burning end of a smoking device is not colored, but smoke exhaled by the smoker is. In such embodiments, smoke being drawn through the inhalation portion of a smoking device has color added to it before it is inhaled by a smoker. For example, one embodiment includes an external mouthpiece that is slid over the inhalation end of a pipe. As a smoker draws smoke from the pipe, the smoke passes through the external mouthpiece. The external mouthpiece includes a coloring agent that adds color to the smoke as it passes through the external mouthpiece. As another example, one embodiment includes a cigarette holder that accepts the inhalation portion of a cigarette. In other embodiments, such a colored smoke module would be inserted internally into a cigarette or other smoking device. For instance, another embodiment of the present invention includes a colored smoke module including a pin adapted to be inserted into the filter of a cigarette. As smoke is drawn through the filter the smoke becomes colored. For these embodiments that do not require the colored smoke module to be combusted, the colored smoke module may be re-used with multiple smoking devices.

A further embodiment of the present invention heightens the aesthetic effect of smoke with the use of bubbles made from soap or a similar substance that can form a membrane around smoke. In a colored smoke scenario, after a colored smoke module has been added to a smoking device, bubbles may be made containing colored smoke produced by the smoking device. For example, a smoker may inhale smoke from a smoking device, and then exhale across a membrane of soap or similar substance spread across a hoop or ring. As the smoker exhales, the soap is formed into a bubble around the smoke, until the bubble is completely formed and then breaks away from the hoop and into the atmosphere. The smoke swirls inside the bubble while the bubble remains formed, and is discharged when the bubble ruptures. In alternative embodiments, multiple smokers may inflate the bubble and/or multiple colors of smoke may be used to inflate the bubble for a heightened decorative effect.

As an additional embodiment, the smoke may be introduced to a bubble machine that forms the bubble instead of having individual smokers exhale to form the bubble. Smoke filled bubbles may be formed by using smoke exuding from the smoking device itself in combination with or in the alternative to smoke exhaled by smokers.

Additionally, the smoke-filled bubbles may be kept intact and transported and kept in a sealed and/or vented viewing area to reduce second-hand smoke in an enclosed atmosphere such as a bar, or a house or apartment where a party is being held. As the bubbles rupture in the viewing area, the smoke can be vented outside to a remote area away from the enclosed atmosphere, or the smoke may be contained in a sealed viewing area to be released later in less enclosed quarters.

While the invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiments disclosed, but that the present invention will include all embodiments falling within the scope of the appended claims.

The invention claimed is:

1. A colored smoke module mountable to a pre-formed combustion portion of a smoking device, wherein said smoking device includes an inhalation portion operatively joined to said combustion portion, said colored smoke module comprising a colored smoke module body adapted for placement to and removal from said pre-formed combustion portion of said smoking device by a user of said smoking device, said colored smoke module adapted to be burned along with said combustion portion and to produce colored smoke when said smoking device is used to smoke a combustible product; and wherein said colored smoke module body comprises a combustible pin adapted to be inserted into said combustion portion of said smoking device and to be positioned in said combustion portion when said smoking device is used to smoke a combustible product.

2. The colored smoke module of claim 1 comprising a visual indicator, said visual indicator providing a visual cue providing information about said colored smoke module body.

3. The colored smoke module of claim 2 wherein said visual indicator comprises a tag mounted to said colored smoke module body.

4. The colored smoke module of claim 2 wherein said visual indicator comprises a mark made on said colored smoke module body.

5. The colored smoke module of claim 1 wherein said colored smoke module is adapted to be mountable to and removable from a pre-formed cigarette.

6. A smoking device comprising:

an inhalation portion;

a combustion portion operatively joined to said inhalation portion, said combustion portion comprising a wrapping paper surrounding a tobacco rod;

a colored smoke module comprising a colored smoke module body adapted for placement to and removal from said combustion portion of said smoking device by a user of said smoking device, said colored smoke module adapted to be burned along with said combustion portion and to produce colored smoke when said smoking device is used to smoke a combustible product; and wherein said colored smoke module body comprises a combustible pin adapted to be inserted into said combustion portion of said smoking device and to be positioned in said combustion portion when said smoking device is used to smoke a combustible product.

7. The smoking device of claim 6 wherein said colored smoke module further comprises a visual indicator, said visual indicator providing a visual cue providing information about said colored smoke module body.

8. The smoking device of claim 7 wherein said visual indicator comprises a tag mounted to said colored smoke module body.

9. The smoking device of claim 7 wherein said visual indicator comprises a mark made on said colored smoke module body.

10. A colored smoke module system comprising a plurality of colored smoke modules mountable to a combustion portion of a cigarette, wherein said cigarette includes an inhalation portion operatively joined to said combustion portion and said combustion portion includes a wrapping paper surrounding a tobacco rod, said colored smoke modules comprising colored smoke module bodies adapted for placement to and removal from said combustion portion of said cigarette by a user of said cigarette, each said colored smoke module adapted to be burned along with said combustion portion and to produce colored smoke when a cigarette to which said colored smoke module is mounted to is used to smoke a combustible product, and wherein said colored smoke module body comprises a combustible pin adapted to be inserted into said combustion portion of said smoking device and to be positioned in said combustion portion when said smoking device is used to smoke a combustible product.

11. The colored smoke module system of claim 10 wherein said colored smoke modules comprise a first colored smoke module that produces a first color of smoke when burned, and a second colored smoke module that produces a second color of smoke when burned.

12. The colored smoke module system of claim 10 further comprising a plurality of cigarettes, wherein said plurality of colored smoke modules are adapted for placement to and removal from said plurality of cigarettes.

* * * * *